United States Patent [19]

Schütz

[11] Patent Number: 4,500,010

[45] Date of Patent: Feb. 19, 1985

[54] WIDE-NECKED CONTAINER OF A SYNTHETIC RESIN WITH REMOVABLE LID

[76] Inventor: Udo Schütz, Am Rückersteg 4, D-5418 Selters, Fed. Rep. of Germany

[21] Appl. No.: 576,762

[22] Filed: Feb. 1, 1984

[30] Foreign Application Priority Data

Feb. 17, 1983 [DE] Fed. Rep. of Germany ..... 3305346

[51] Int. Cl.[3] ..... B65D 45/32

[52] U.S. Cl. ..... 220/320

[58] Field of Search ..... 220/319, 320, 321, 355

[56] References Cited

U.S. PATENT DOCUMENTS 3,424,340 1/1969 Rocher ..... 220/320
4,177,934 12/1979 Hammes et al. ..... 220/320

FOREIGN PATENT DOCUMENTS 2544491 4/1977 Fed. Rep. of Germany .
3108442 12/1982 Fed. Rep. of Germany .
3238076 9/1983 Fed. Rep. of Germany .

*Primary Examiner*—George T. Hall
*Attorney, Agent, or Firm*—Young & Thompson

[57] ABSTRACT

The wide-necked barrel of a synthetic resin can be sealed by a lid exhibiting a bottom entering into the barrel neck by way of an inner rim, and an outer rim extending over the barrel neck and having a radial lid flange. The lid is sealed by a sealing ring inserted into the annular groove between the inner rim and the outer rim of the lid. The lid flange has on the underside alternatingly tongue-like extensions and recesses arranged with a specific pitch over the circumference of the lid. Annular flange segments integrally molded to the barrel neck engage into the flange recesses and complete the partial cross-sectional profile of the lid flange, formed in the zone of the recesses, to the full cross-sectional profile of the lid flange in the zone of the extensions. The clamping ring encompassing the lid flange and the annular flange segments is secured by means of clamping ridges integrally molded to the lid extensions and extending in the circumferential direction.

6 Claims, 8 Drawing Figures

WIDE-NECKED CONTAINER OF A SYNTHETIC RESIN WITH REMOVABLE LID

Figure 1:
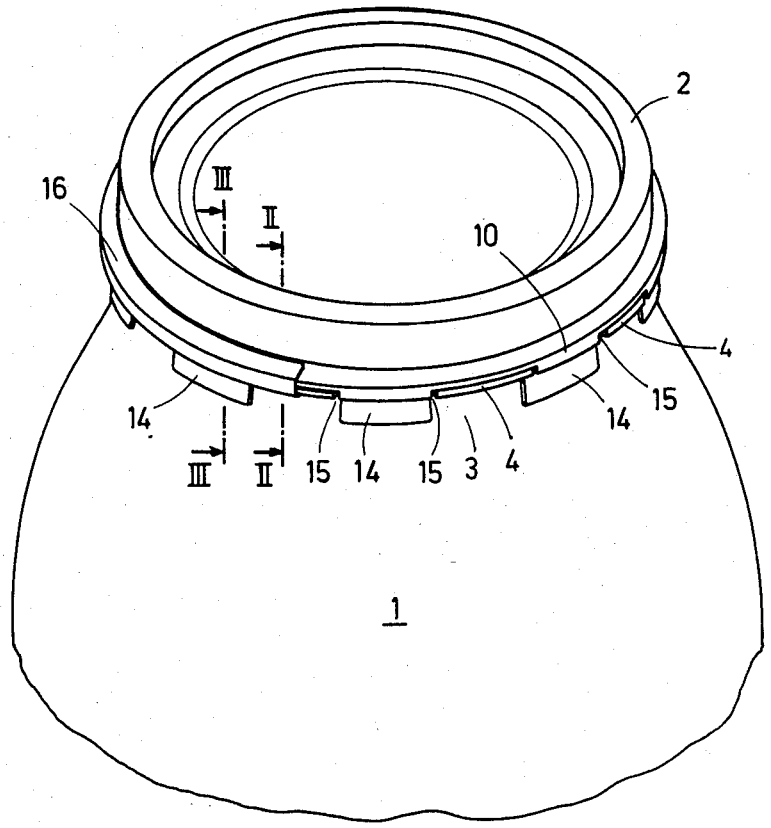

The invention relates to a wide-necked barrel of a synthetic resin with removable lid according to the preamble of claim 1.

Such a synthetic-resin barrel has been known from DOS No. 3,108,442. In this barrel lid closure, the lid flange is braced by means of a clamping ring against an annular flange integrally formed at the neck of the barrel. One disadvantage in this lid closure resides in the inadequate drop safety due to the fact that the clamping ring profile is bent away at some places upon impingement of the barrel jacket on the ground, due to the elliptical deformation of the barrel neck, so that the tightness of the seal is no longer ensured after the elastic reformation of the barrel and, with relatively large dropping heights, there is even the danger of the clamping ring jumping off the two annular flanges at the lid and at the barrel neck, and the lid being opened.

DAS No. 2,258,096 discloses a synthetic-resin barrel with a closure lid exhibiting a lip-like bead axially engaging into the barrel neck and a rim, extending on the outside over the barrel neck, with segment-like arranged extensions pointing obliquely downwardly; these extensions respectively receive between them projections integrally formed at the barrel neck, the extensions of the lid and the projections of the barrel neck constituting—as seen in the circumferential direction—a V-shaped groove for the mounting of a clamping ring. During sealing of the barrel, the clamping ring rests, in the loosely tensioned condition, alternately loosely on the guide and contact surfaces of the projections at the barrel neck and the extensions at the barrel lid, and with increasing tension pulls the barrel lid downwardly onto the barrel neck. By the arrangement of the contact surfaces at the lid extensions a little below the contact surfaces of the barrel neck projections, the clamping ring, in the tensioned condition, is urged upwardly by the guide and contact surfaces of the lid extensions and downwardly by the guide and contact surfaces of the barrel neck projections whereby an undulating, elastic deformation of the clamping ring, which consists of round spring steel wire, is obtained by tensioning the clamping ring by a conventional turnbuckle.

This known barrel lid closure is burdened by decisive disadvantages:

The barrel neck projections are fashioned as bulges hollow toward the interior of the barrel, integrally molded during the blow molding of the barrel. This shaping design leads to an extensive fissuring of the barrel neck so that the latter acts like a bellows under radial and/or axial stresses, especially during transport, whereby the seal between lid and barrel is impaired. The serration of the lid and the barrel neck, wherein the barrel neck projections are extended through the outer lid rim, has the result that the clamping strap is unable to exert on the lid an axial clamping and sealing force which is uniformly distributed over the lid circumference; consequently, the seal between the lid and the barrel neck is additionally impaired. Finally, during sealing of the barrel, the clamping ring must be positioned so that the turnbuckle is at all times between two barrel neck projections whereby sealing of the barrel is made difficult.

The invention is based on the object of developing a lidded barrel of a synthetic resin with a removable synthetic—resin lid, the seal of which ensures absolute tightness during shock-like transporting stresses and under static loads during stacking, and generates a sealing tension which is uniform over long periods of time.

This object has been attained according to this invention by the features in the characterizing portion of claim 1.

Suitable constructions and modified embodiments of the invention form the subject matter of the dependent claims.

Figure 2:
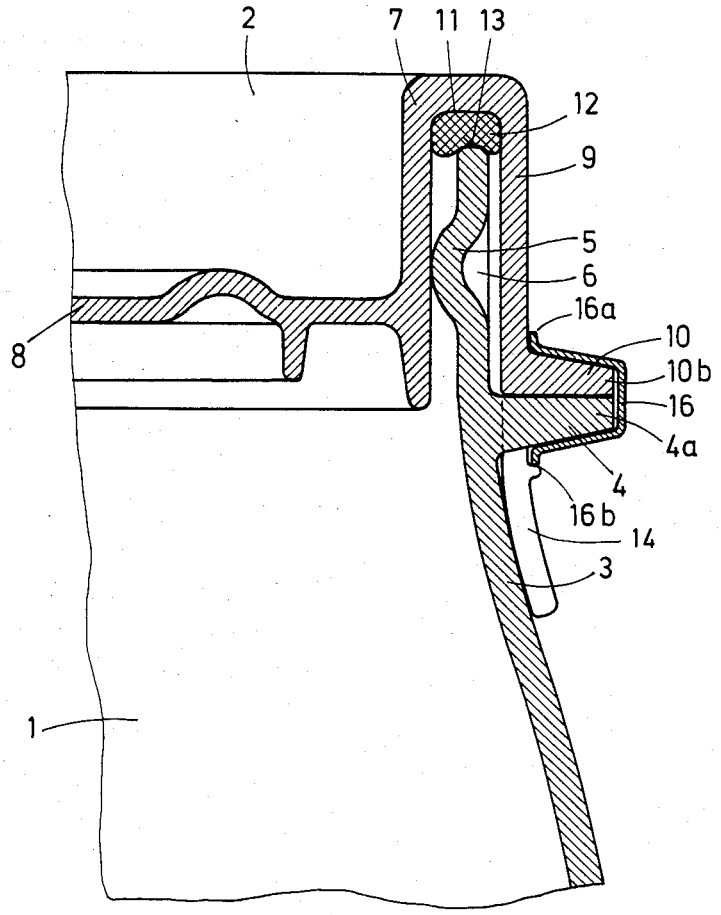
Figure 3:
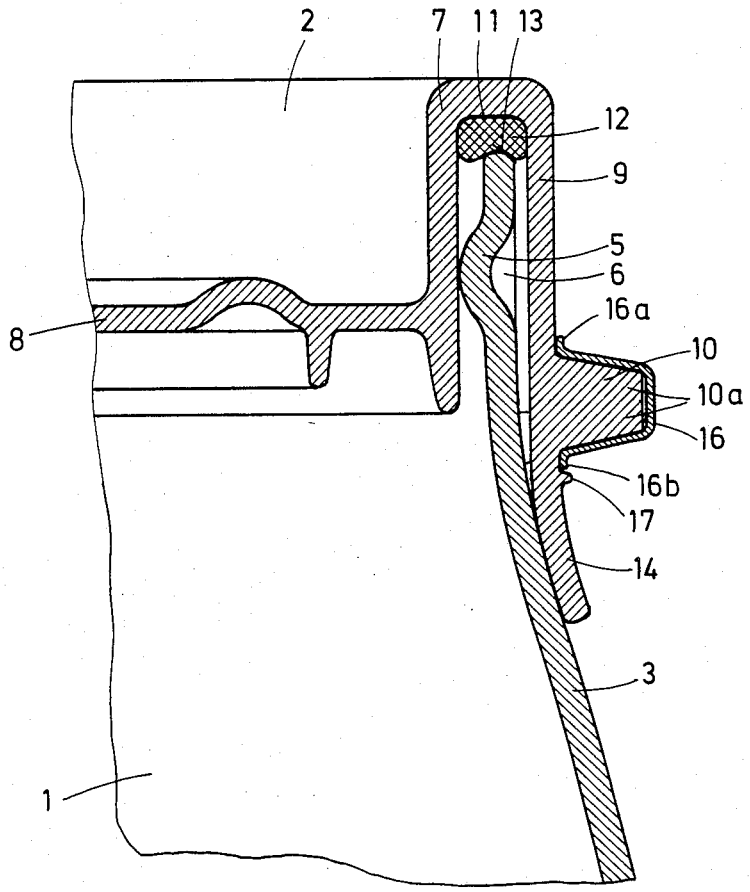
Figure 4:
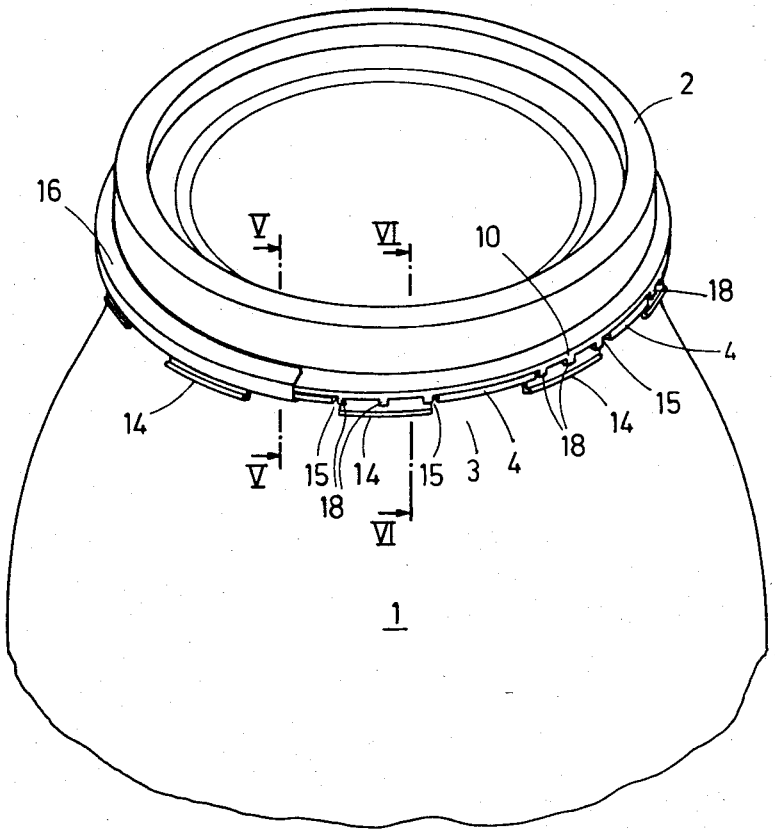
Figure 5:
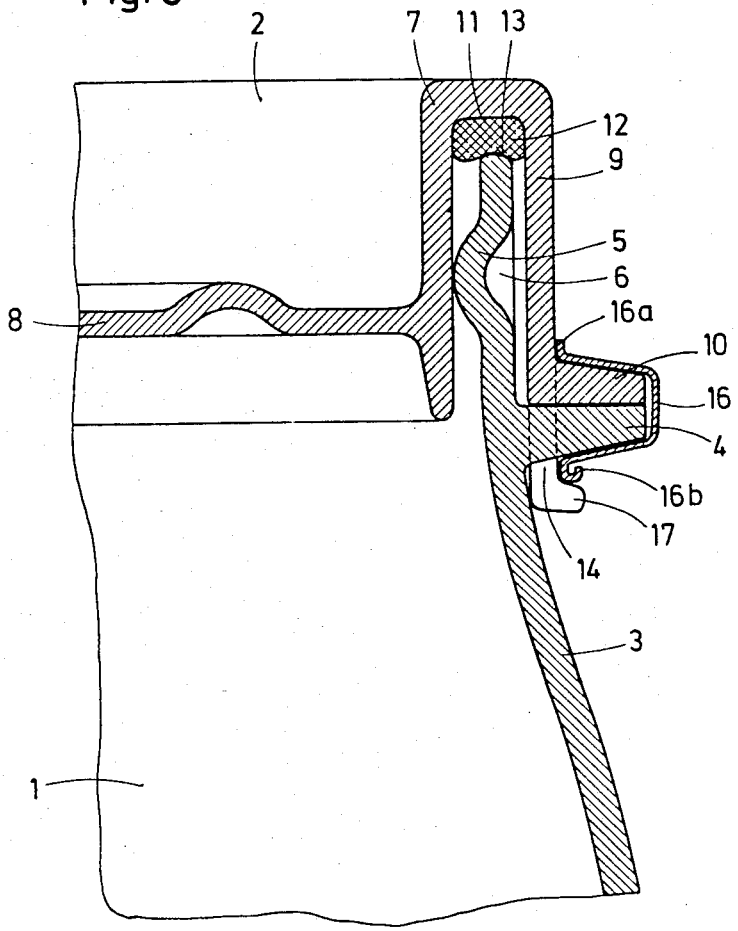
Figure 6:
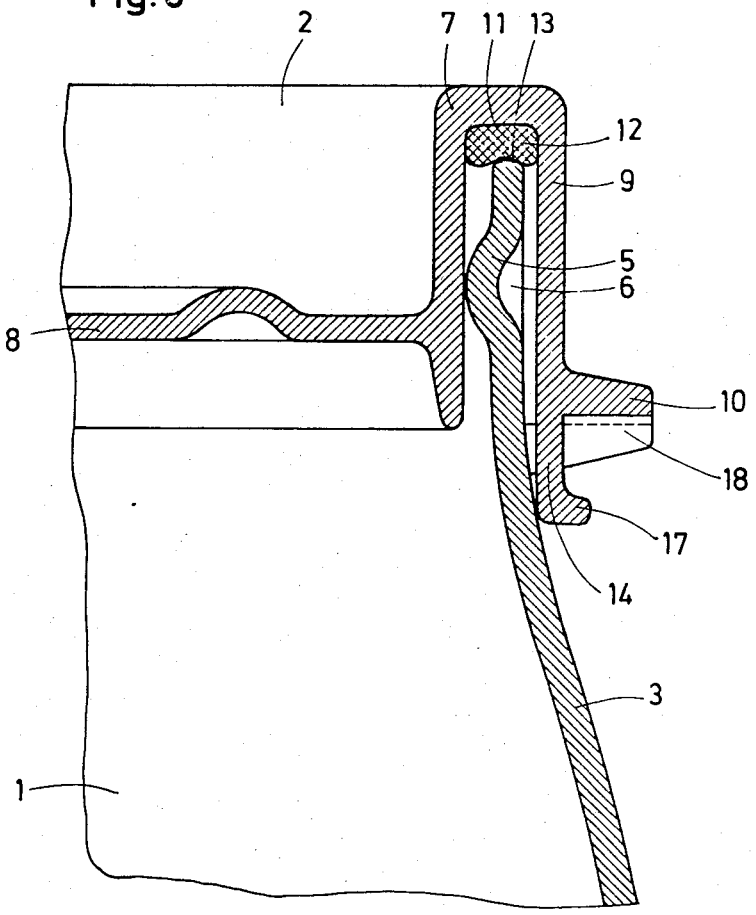
Figure 7:
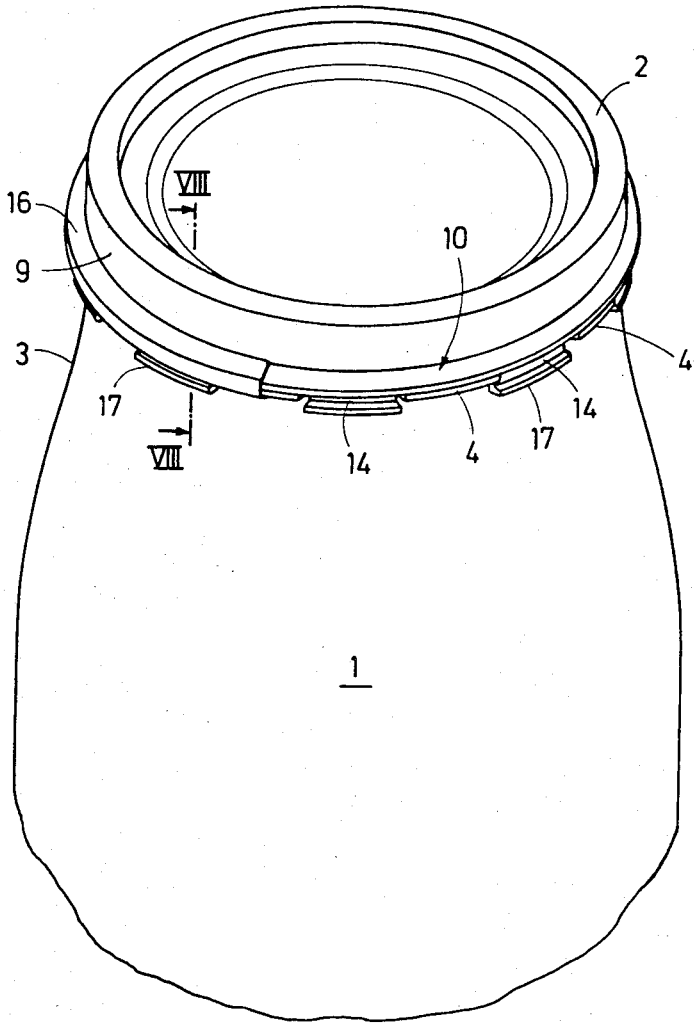
Figure 8:
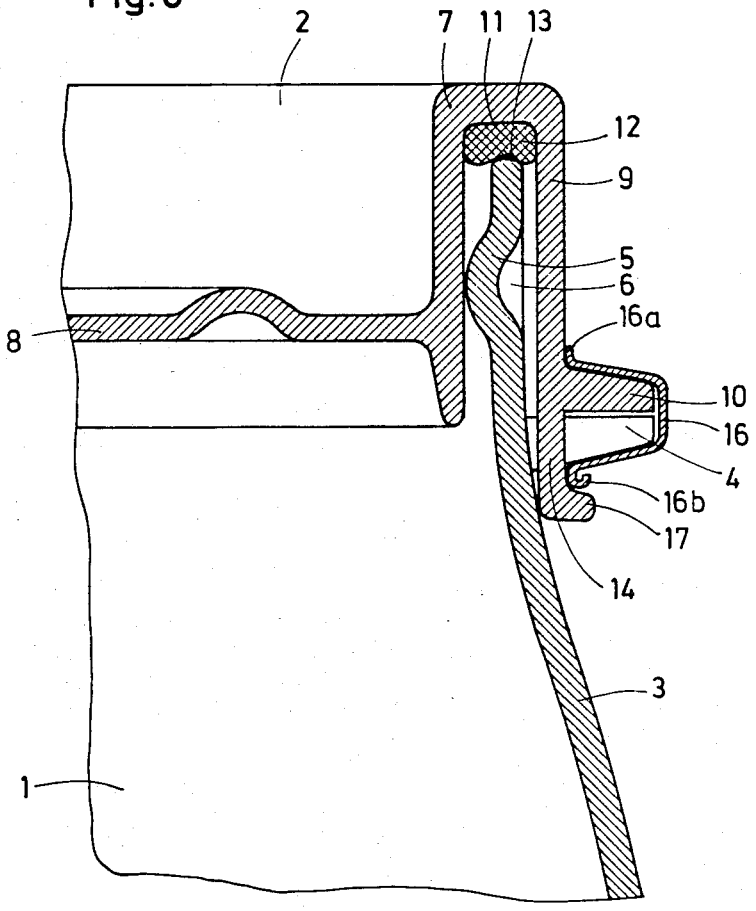

The invention will be explained in greater detail below with reference to an example illustrated in the drawings wherein:

FIG. 1 is a perspective partial view of a first embodiment of the wide-necked barrel, wherein the clamping ring has been partially omitted to clearly show the closure, FIGS. 2 and 3 show cross sections of the lid closure along lines II—II and III—III of FIG. 1 in a representation enlarged as compared with FIG. 1, FIG. 4 shows a second embodiment of the lid closure, FIGS. 5 and 6 show sections along lines V—V and VI—VI, respectively, in FIG. 4, FIG. 7 shows a third embodiment of the lid closure, and FIG. 8 shows a section along line VIII—VIII in FIG. 7.

The synthetic-resin barrel 1, sealable with a synthetic-resin lid 2 as shown in FIG. 1 is blow-molded conventionally, for example of polyethylene, a portion of the blow mold being constricted in the axial direction in the zone of the barrel neck 3 in such a way that the synthetic resin material is dammed up to produce, over the entire circumference of the barrel neck 3, annular flange segments 4 which are oriented radially outwardly at a specific pitch. The cross-sectional profile of these annular flange segments 4 is fashioned, for example, as a half-trapezoidal profile 4*a* (FIG. 2).

Annular bead segments 5, oriented radially inwardly, are molded into the barrel neck 3 above the annular flange segments 4; these annular bead segments 5 are separated from one another by ridges 6 (FIGS. 2 and 3).

The lid 2, attached to the barrel neck 3, comprises a bottom 8, entering into the barrel neck 3 by way of an inner rim 7, and an outer rim 9 extending over the barrel neck 3 and having a lid flange 10 fashioned as an annular flange.

The inner rim 7 and the outer rim 9 of the lid 2 encompass an annular groove 11 into which a sealing ring 12 is inserted, this ring being urged against the planar top edge 13 of the barrel neck 3.

The inner rim 7 of the lid 2 is supported on the annular bead segments 5 of the barrel neck 3 when the barrel 1 is under mechanical stress.

The lid flange 10 exhibits on the underside alternatingly tongue-like extension 14 and recesses 15, arranged with a certain graduation over the lid circumference. The cross-sectional profile of the lid flange 10 is formed, in the zone of the extensions 14, for example as an externally tapering trapezoidal profile 10*a*. With the lid 2 being closed, the annular flange segments 4 molded onto the barrel neck 3 engage into the corresponding recesses 15 of the lid flange 10. The annular flange segments 4 on the barrel neck 3 with the cross-sectional profile 4*a* supplement the partial cross-sectional profile 10*b* of the lid flange 10, fashioned, for example, as a half-trapezoidal profile and formed in the zone of the recesses 15, to the full cross-sectional profile of the lid flange 10 in the zone of the extensions 14, which latter profile is configured as a trapezoidal profile 10*a*.

A clamping ring 16 of a conventional type serves for sealing the barrel lid 2; this clamping ring is to be closed and opened by means of a turnbuckle and has a hollow cross-sectional profile adapted to the trapezoidal profile 10*a* of the lid flange 10. The end edges of the clamping ring 16 are bent over into supporting rings 16*a*, 16*b*, with which the clamping ring 16 rests on the lid 2 and its extensions 14. The clamping ring 16 is secured by clamping ridges 17 integrally molded to the lid extensions 14 and extending in the circumferential direction; these clamping ridges prevent deformation of the clamping ring 16 and, if necessary, detachment of the latter from the lid flange 10 and from the annular flange segments 4 of the barrel neck 3.

In order to seal the barrel 1, the clamping ring 16 is pushed loosely over the lid flange 10 of the lid 2 placed on the barrel neck 3, as well as over the annular flange segments 4 at the barrel neck 3. By tightening the turnbuckle, not shown, the clamping ring 16 is tightened thus bracing the lid 2 in the axial direction with the flange 10 firmly against the annular flange segments 4 at the barrel neck 3 with simultaneous clamping of the sealing ring 12 between the lid 2 and the top edge 13 of the barrel neck 3.

In the embodiment of FIGS. 4–6, identical parts are denoted by the same reference numerals as in FIGS. 1–3. This embodiment differs from the above-described, first embodiment merely in that trapezoidal ribs 18, namely preferably three of them, are molded to the underside of the lid flange 10 in the zone of the extensions 14 which here are shorter, in order to supplement the full trapezoidal profile 10*a* corresponding to the inner hollow profile of the clamping ring 16.

FIGS. 7 and 8 show an embodiment wherein the full trapezoidal profile is not filled out in the zone of the extensions 14, but rather the lid flange 10 has a uniform profile all around.

As compared with the conventional barrel lid seals, the above-described lid closures are distinguished by maximum safety against shock-life axial and/or radial stresses during transport, especially during dropping, and against static loads during stacking of the barrels, as well as by a constant closure tension and a resultant absolute tightness over long periods of time. These advantages result from the following features:

The rigidity of the lid is decisively improved by the external, continuous lid rim with the radially outwardly oriented lid flange. The annular bead segments arranged in the barrel neck to support the inner rim of the barrel lid in case of great radial stresses contribute toward an additional increase in rigidity of the lid. The clamping ridges at the tongue-like lid extensions prevent unbending and loosening of the clamping ring under very high shock stresses during dropping. Furthermore, the tongue-like extensions with the clamping ridges, firmly braced against the barrel neck, prevent loosening of the lid in case of an elastic, elliptical deformation of the barrel neck under the influence of large external forces. Due to the uniform tightening of the lid in the axial direction against the barrel neck during closing of the turnbuckle of the clamping strap, the sealing ring between the lid and the barrel neck is exposed to a uniform sealing force.

Finally, opening and closing of the lid is substantially simplified as compared with known lid closures, since the clamping ring need not be aligned, and the lid can be seized at the lid rim and the lid lugs.

I claim:

1. Wide-necked barrel of a synthetic resin with a removable lid exhibiting a bottom entering into the barrel neck by way of an inner rim, and an outer rim extending over the barrel neck with a radial lid flange which is braced by means of a clamping ring against a closure element integrally molded to the barrel neck, a sealing ring inserted into the annular groove between the inner rim and the outer rim of the lid being urged against the top edge of the barrel neck, characterized in that the lid flange (10) exhibits on the underside alternatingly tongue-like extensions (14) and recesses (15) arranged with a specific pitch over the circumference of the lid; that radially outwardly oriented annular flange segments (4), molded on the barrel neck (3), engage into the flange recesses (15), these segments completing a partial cross-sectional profile (10*b*) of the lid flange (10), formed in the zone of the recesses (15), to a full cross-sectional profile (10*a*) of the lid flange (10) in the zone of the extensions (14); and that the clamping ring (16) encompassing the lid flange (10) and the annular flange segments (4) is secured by means of clamping ridges (17) integrally molded with the lid extensions (14) and extending in the circumferential direction.

2. Wide-necked barrel according to claim 1, characterized in that the cross-sectional profile (10*a*) of the lid flange (10) is fashioned in the zone of the extensions (14) as an outwardly tapering trapezoidal profile.

3. Wide-necked barrel according to claim 1, characterized by radially inwardly oriented annular bead segments (5) molded into the barrel neck (3) above the annular flange segments (4).

4. Wide-necked barrel according to claim 1, characterized in that the cross-sectional profile of the lid flange (10) is all around the same at any location, and corresponds to half the profile of the inner cross section of the clamping ring (16).

5. Wide-necked barrel according to claim 1, characterized in that downwardly projecting trapezoidal ribs (18) are molded integrally with the lid flange (10) in the zone of the extensions (14), these ribs supplementing the profile of the inner cross section of the clamping ring (16).

6. Wide-necked barrel according to claim 5, characterized in that three trapezoidal ribs (18) are provided in the zone of each extension (14).

* * * * *